US008389463B2

(12) United States Patent
Mohs et al.

(10) Patent No.: US 8,389,463 B2
(45) Date of Patent: Mar. 5, 2013

(54) ENHANCED DISPENSING OF SOLID COMPOSITIONS

(75) Inventors: Thomas R. Mohs, Eagan, MN (US); Jennifer L. Bergerson, Moundsview, MN (US); Amanda R. Blattner, Prior Lake, MN (US); Charles A. Hodge, Cottage Grove, MN (US); Steven E. Lentsch, St. Paul, MN (US); Jacob Pitt, White Bear Lake, MN (US)

(73) Assignee: Ecolab USA Inc., St. Paul, MN (US)

( * ) Notice: Subject to any disclaimer, the term of this patent is extended or adjusted under 35 U.S.C. 154(b) by 67 days.

(21) Appl. No.: 12/614,540

(22) Filed: Nov. 9, 2009

(65) Prior Publication Data

US 2011/0112003 A1 May 12, 2011

(51) Int. Cl.
*C11D 17/00* (2006.01)
*C11D 17/06* (2006.01)
*C11D 1/722* (2006.01)

(52) U.S. Cl. ..... 510/445; 510/224; 510/225; 510/294; 510/298; 510/356; 510/446

(58) Field of Classification Search ..... 510/224, 510/294, 445, 225, 298, 356, 446, 421, 505
See application file for complete search history.

(56) References Cited

U.S. PATENT DOCUMENTS

| | | | | |
|---|---|---|---|---|
| 3,048,548 | A | 8/1962 | Martin et al. | |
| 3,334,147 | A | 8/1967 | Brunelle et al. | |
| 3,442,242 | A | 5/1969 | Laskey et al. | |
| 4,618,914 | A | 10/1986 | Sato et al. | |
| 4,830,773 | A | 5/1989 | Olson | |
| 4,846,993 | A * | 7/1989 | Lentsch et al. | 510/222 |
| 5,118,440 | A | 6/1992 | Cutler et al. | |
| 5,254,290 | A | 10/1993 | Blandiaux et al. | |
| 5,419,850 | A * | 5/1995 | Backes et al. | 510/225 |
| 5,490,949 | A * | 2/1996 | Backes et al. | 510/445 |
| 5,665,694 | A * | 9/1997 | Backes et al. | 510/480 |
| 5,691,289 | A | 11/1997 | Purcell et al. | |
| 5,776,874 | A * | 7/1998 | MacBeath et al. | 510/220 |
| 5,780,417 | A | 7/1998 | Gorlin | |
| 5,935,920 | A * | 8/1999 | Geke et al. | 510/245 |
| 5,948,742 | A | 9/1999 | Chang et al. | |
| 6,060,441 | A | 5/2000 | Hessel et al. | |
| 6,150,324 | A * | 11/2000 | Lentsch et al. | 510/446 |
| 6,369,021 | B1 | 4/2002 | Man et al. | |
| 6,627,612 | B1 | 9/2003 | O'Lenick, Jr. et al. | |
| 6,770,616 | B1 * | 8/2004 | McGowan et al. | 510/446 |
| 6,881,710 | B1 | 4/2005 | O'Lenick, Jr. et al. | |
| 6,958,315 | B1 | 10/2005 | Anderson et al. | |
| 6,964,942 | B2 | 11/2005 | Murch et al. | |
| 7,087,571 | B1 | 8/2006 | O'Lenick, Jr. et al. | |
| 7,335,627 | B1 | 2/2008 | O'Lenick et al. | |
| 7,341,983 | B2 | 3/2008 | Pedersen et al. | |
| 2002/0035051 | A1 | 3/2002 | Alam et al. | |
| 2002/0055448 | A1 | 5/2002 | Ruggiero et al. | |
| 2002/0151448 | A1 | 10/2002 | Mitra et al. | |
| 2002/0183222 | A1 | 12/2002 | Foley et al. | |
| 2003/0064910 | A1 | 4/2003 | Fong et al. | |
| 2003/0073600 | A1 | 4/2003 | Avery et al. | |
| 2003/0119689 | A1 | 6/2003 | Hutton et al. | |
| 2003/0134765 | A1 | 7/2003 | Kapur et al. | |
| 2004/0002432 | A1 * | 1/2004 | Okuda et al. | 510/226 |
| 2004/0029752 | A1 | 2/2004 | Sava et al. | |
| 2004/0116317 | A1 * | 6/2004 | Burt et al. | 510/447 |
| 2004/0182425 | A1 | 9/2004 | Kravitz et al. | |
| 2005/0101508 | A1 | 5/2005 | Winter et al. | |
| 2005/0107280 | A1 * | 5/2005 | Borchers et al. | 510/421 |
| 2005/0239674 | A1 | 10/2005 | Dreja et al. | |
| 2006/0105934 | A1 * | 5/2006 | Thankachan et al. | 510/421 |
| 2006/0222614 | A1 | 10/2006 | Buck | |
| 2006/0281653 | A1 | 12/2006 | Hutton et al. | |
| 2008/0139443 | A1 | 6/2008 | Buzinski et al. | |
| 2008/0255014 | A1 | 10/2008 | Luu et al. | |
| 2008/0274932 | A1 * | 11/2008 | Smith et al. | 510/225 |
| 2008/0274940 | A1 * | 11/2008 | Tjelta et al. | 510/445 |
| 2008/0274942 | A1 * | 11/2008 | Tjelta et al. | 510/445 |
| 2008/0276967 | A1 * | 11/2008 | Smith et al. | 134/18 |
| 2009/0007936 | A1 | 1/2009 | Uhl et al. | |
| 2009/0054287 | A1 * | 2/2009 | Smith et al. | 510/161 |
| 2009/0165818 | A1 * | 7/2009 | Smith et al. | 134/7 |
| 2011/0067188 | A1 * | 3/2011 | Man et al. | 15/104.93 |

FOREIGN PATENT DOCUMENTS

| | | |
|---|---|---|
| EP | 0140452 | 12/1989 |
| EP | 0086614 | 11/1997 |
| EP | 0623670 | 7/2001 |
| EP | 0659874 | 10/2002 |
| EP | 0805200 | 7/2003 |
| EP | 0691397 | 10/2004 |
| EP | 1290122 | 5/2007 |
| GB | 2194955 | 3/1988 |
| GB | 2272450 | 5/1994 |
| GB | 2290798 | 1/1996 |
| GB | 2336373 | 10/1999 |

(Continued)

OTHER PUBLICATIONS

Tucker, C. et al. "High Throughput Surfactant Synthesis, Characterization and Formulation", SOFW Journal (2008), 134(9), pp. 80, 82-84, 86-90.*
Glucopon® 625 UP, www.cognis.com, Aug. 18, 2008, 2 pages.
Glucopon® Surfcants, All You Need for Environmentally Friendly & Safe Cleansing Applications, Cognis Corporation, Jun. 2006, 1 page.
The Original APG®, Cognis Corporation, Apr. 2006, 1 page.
Plurafac® SL-42 Linear Alcohol Alkoxylate, BASF, © 2002, 2 pages.
Plurafac® SL-42 Linear Alcohol Alkoxylate, Technical Bulletin, BASF, © 2007, 2 pages.
Suga®Nate, Colonial Chemical, Inc., © Copyright 2007, 4 pages.
Suga®Phos, Colonial Chemical, Inc., last modified Jul. 18, 2006, 6 pages.
Ecosurf™ SA Surfactants, New high-Performance, Seed Oil-Based Nonionic Surfactants with Excellent Environmental and Handling Properties, Published Jan. 2008 by the Dow Chemical Company.

(Continued)

*Primary Examiner* — Lorna M Douyon
(74) *Attorney, Agent, or Firm* — Andrew D. Sorensen; Amy J. Hoffman

(57) ABSTRACT

A solid detergent composition includes an ethoxylated and propoxylated surfactant, an alkalinity source, a solidification agent and a chelating agent. The ethoxylated and propoxylated surfactant can include a surfactant blend of naturally sourced ethoxylated and propoxylated surfactants.

6 Claims, No Drawings

FOREIGN PATENT DOCUMENTS

| | | |
|---|---|---|
| GB | 2370042 | 6/2002 |
| WO | WO 9316162 | 8/1993 |
| WO | WO 9319149 | 9/1993 |
| WO | WO 9403572 | 2/1994 |
| WO | WO 9412609 | 6/1994 |
| WO | WO 9502390 | 1/1995 |
| WO | WO 9618711 | 6/1996 |
| WO | WO 9711146 | 3/1997 |
| WO | WO 9811185 | 3/1998 |
| WO | WO 9812294 | 3/1998 |
| WO | WO 9855569 | 12/1998 |
| WO | WO 0100779 | 1/2001 |
| WO | WO 03080780 | 10/2003 |
| WO | WO 2006124484 | 11/2006 |
| WO | WO 2008088647 | 7/2008 |
| WO | WO 2008094718 | 8/2008 |
| WO | WO 2010139107 A1 * | 12/2010 |

* cited by examiner

ENHANCED DISPENSING OF SOLID COMPOSITIONS

TECHNICAL FIELD

The present invention relates generally to the field of solid-based detergents. In particular, the present invention relates to a solid-based detergent including a surfactant having both ethoxylated and propoxylated groups.

BACKGROUND

Conventional detergents used in the warewashing and laundering industries, particularly those intended for institutional use, typically contain alkyl phenol ethoxylates (APEs) and phosphates. APEs are used in detergents as a cleanser and a degreaser for their effectiveness at removing soils containing grease from a variety of surfaces. Commonly used APEs include nonyl phenol ethoxylates (NPE) surfactants.

Phosphates are multifunctional components commonly used in detergents to reduce water hardness as well as increase detergency, antiredeposition, and crystal modification. Detergency is defined as the ability to wet, emulsify, suspend, penetrate, and dispense soils. In particular, polyphosphates such as sodium tripolyphosphate and their salts are used in detergents because of their ability to prevent calcium carbonate precipitation and their ability to disperse and suspend soils. If calcium carbonate is allowed to precipitate, the crystals may attach to the surface being cleaned and cause undesirable effects. For example, calcium carbonate precipitation on the surface of ware can negatively impact the aesthetic appearance of the ware and give the ware an unclean look. In the laundering area, if calcium carbonate precipitates and attaches onto the surface of fabric, the crystals may leave the fabric feeling hard and rough to the touch.

However, while effective, both APEs and phosphates are disfavored due to environmental concerns. There is therefore a need in the art for alternatives that can replace the properties of APEs and phosphorous-containing compounds.

SUMMARY

In one embodiment, the present invention is a solid detergent composition including between about 1% and about 60% by weight of an ethoxylated and propoxylated surfactant, between about 1% and about 50% by weight of an alkalinity source, between about 1% and about 12% by weight of a solidification agent and between about 1% and about 60% by weight of a chelating agent.

In another embodiment, the present invention is a solid detergent composition including a palm kernel based surfactant including ethoxylated and propoxylated groups, an alkalinity source, a solidification agent, and a chelating agent.

In yet another embodiment, the present invention is a method cleaning a surface using a solid composition. The method includes mixing an ethoxylated and propoxylated surfactant, an alkalinity source, a solidification agent and a chelating agent to form a solid composition, diluting at least part of the solid composition with water to form a use solution, dispensing the use solution and contacting the surface with the use solution.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

DETAILED DESCRIPTION

Ethoxylated and Propoxylated Surfactant Containing Compositions and Methods Employing Them The present invention relates to solid detergent compositions and methods of using the solid detergent compositions for cleaning and removing organic soils from an object or surface. The solid detergent compositions include a surfactant or surfactant blend having both ethoxylated and propoxylated groups. In one embodiment, the solid detergent compositions are substantially free of phosphorous-containing compounds and alkyl phenol ethoxylates (APEs) such as nonyl phenol ethoxylate (NPE). The surfactant or surfactant blend having both ethoxylated and propoxylated groups provides a biodegradeable and odor free replacement for conventional detergent surfactants such as phosphoric acid and APEs. The solid detergent composition can be used in various detergent applications, including for example, warewashing and laundering. The solid detergent composition can also be used in various industries including, but not limited to: institutional, food and beverage, vehicle care, quick service restaurants and textile care.

In one embodiment, the solid detergent composition includes a surfactant or surfactant blend including both ethoxylated and propoxylated groups, a solidification agent, a chelating agent and an alkalinity source.

The surfactant or surfactant blend includes both ethoxylated and propoxylated groups that function to enhance the dispensing capability of the solid detergent composition. The ethoxylated and propoxylated surfactants have high wetting ability and low aqueous surface tension. The surfactants are also have high water solubility with rapid aqueous dissolution. The propoxylated groups of the surfactants contain some branching. Without being bound by theory, it is believed that the branching aids in increasing the dispensing rate of the solid composition and that the propxylation prevents the gelling onset out beyond the operating window, thereby increasing the dispensing rate of the composition. Because the ethoxylated and propoxylated surfactants have an insignificant or no gelling range, they can be used in concentrates. Examples of suitable surfactants including both ethoxylated and propoxylated groups include, but are not limited to, nonionic seed oil surfactants and ethoxylated and propoxylated surfactants having between 6 and about 18 carbon chains. Examples of particularly suitable surfactants including both ethoxylated and propoxylated groups have a cloud point between about 1 and about 100° C., particularly between about 10 and about 80° C., and more particularly between about 20 and about 70° C.; an HLB between about 2 and about 25, particularly between about 3 and about 20, and more particularly between about 3 and about 14; and an equilibrium surface tension (dynes/cm, measured at 0.1 wt % and 25° C.) of between about 20 and about 40, particularly between about 22 and about 35, and more particularly between about 23 and about 30. Examples of particularly suitable commercially available surfactants including both ethoxylated and propoxylated groups include, but are not limited to, Ecosurf SA-7 (a palm kernel alcohol ethoxylated and propoxylated surfactant) and Ecosurf SA-3 (a palm kernel alcohol ethoxylated and propoxylated surfactant), both available from Dow Chemical Company, Midland, Mich. The above surfactants may also be blended to combine a surfactant blend.

The solidification agent contributes to the uniform solidification of the composition by providing an effective amount of hardness and/or aqueous solubility to the processed composition. When mixed with the other components of the detergent composition, the solidification agent is capable of forming a homogeneous matrix such that there is a uniform dissolution of the components during use. The solidification matrix includes a compound or system of compounds that may be organic or inorganic. An example of a suitable organic solidification agent is a polyethylene glycol (PEG) compound. Examples of suitable polyethylene glycols include, but are not limited to: solid polyethylene glycols of the general formula $H(OCH_2CH_2)_nOH$, where n is greater than 15 and particularly approximately 30 to approximately 1700. Typically, the polyethylene glycol has a molecular weight of between approximately 1,000 g/mol and approximately 100,000 g/mol, particularly between approximately 1,450 g/mol and approximately 20,000 g/mol, more particularly between approximately 1,450 g/mol and approximately 8,000 g/mol. Suitable polyethylene glycol compounds include, but are not limited to: PEG 4000, PEG 1450, and PEG 8000 among others, with PEG 4000 being most preferred because of its biodegradability. Examples of inorganic solidification agents include hydratable inorganic salts. Exemplary hydratable inorganic salts include, but are not limited to, sulfates and bicarbonates.

The chelating or sequestering agent aids in removing metal compound soils and in reducing harmful effects of hardness components in service water. Polyvalent metal cations or compounds such as a calcium, a magnesium, an iron, a manganese, a molybdenum, etc. cation or compound, or mixtures thereof, can be present in service water and in complex soils. Such compounds or cations can interfere with the effectiveness of a washing or rinsing composition during a cleaning application. A chelating agent can effectively complex and remove such compounds or cations from soiled surfaces and can reduce or eliminate undesirable interactions with active ingredients, including nonionic surfactants and anionic surfactants. Both organic and inorganic are commonly used chelating agents. Inorganic chelating agents include such compounds as sodium tripolyphosphate and other higher linear and cyclic polyphosphates species. Organic chelating agents include both polymeric and small molecule chelating agents. Organic small molecule chelating agents are typically organocarboxylate compounds or organophosphate chelating agents. Polymeric chelating agents commonly include polyanionic compositions such as polyacrylic acid compounds. Small molecule organic chelating agents include, but are not limited to: sodium gluconate, sodium glucoheptonate, N-hydroxyethylenediaminetriacetic acid (HEDTA), ethylenediaminetetraacetic acid (EDTA), nitrilotriaacetic acid (NTA), diethylenetriaminepentaacetic acid (DTPA), ethylenediaminetetraproprionic acid, triethylenetetraaminehexaacetic acid (TTHA), and the respective alkali metal, ammonium and substituted ammonium salts thereof, ethylenediaminetetraacetic acid tetrasodium salt (EDTA), nitrilotriacetic acid trisodium salt (NTA), ethanoldiglycine disodium salt (EDG), diethanolglycine sodium-salt (DEG), and 1,3-propylenediaminetetraacetic acid (PDTA), dicarboxymethyl glutamic acid tetrasodium salt (GLDA), methylglycine-N—N-diacetic acid trisodium salt (MGDA), and iminodisuccinate sodium salt (IDS). All of these are known and commercially available. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. An example of a particularly suitable chelating agent includes, but is not limited to, sodium aluminosilicate.

The alkalinity source of the solid detergent composition can include, for example, an alkali metal hydroxide, an alkali metal carbonate, or an alkali metal silicate. Examples of suitable alkalinity sources include, but are not limited to: sodium hydroxide, potassium hydroxide, sodium carbonate, potassium carbonate or a mixture of alkali metal sodium hydroxide and alkali metal carbonate. An example of a particularly suitable alkalinity source includes, but is not limited to, sodium carbonate. The alkalinity source controls the pH of the resulting solution when water is added to the detergent composition to form a use solution. The pH of the use solution must be maintained in the proper range in order to provide sufficient detergency properties. In one embodiment, the pH of the use solution is between approximately 5 and approximately 13. Particularly, the pH of the use solution is between about 8 and about 13. More particularly, the pH of the use solution is between about 9 and about 12. If the pH of the use solution is too low, for example, below approximately 4.5, the use solution may not provide adequate detergency properties. If the pH of the use solution is too high, for example, above approximately 13, the use solution may be too alkaline and attack or damage the surface to be cleaned.

The alkalinity source may also function as a hydratable salt to form the solid cast. The hydratable salt can be referred to as substantially anhydrous. By substantially anhydrous, it is meant that the component contains less than about 2% by weight water based upon the weight of the hydratable component. The amount of water can be less than about 1% by weight, and can be less than about 0.5% by weight. However, there is no requirement that the hydratable component be completely anhydrous.

In concentrate form, the solid detergent compositions include between about 1 wt % and about 60 wt % ethoxylated and propoxylated surfactant or surfactant blend, between about 1 wt % and about 12 wt % solidification agent, between about 1 wt % and about 60 wt % chelating agent and between about 1 wt % and about 50 wt % alkalinity source. Particularly, the solid detergent compositions include between about 10 wt % and about 40 wt % ethoxylated and propoxylated surfactant or surfactant blend, between about 2 wt % and about 20 wt % solidification agent, between about 10 wt % and about 39 wt % chelating agent and between about 10 wt % and about 40 wt % alkalinity source. More particularly, the solid detergent compositions include between about 15 wt % and about 30 wt % ethoxylated and propoxylated surfactant or surfactant blend, between about 4 wt % and about 8 wt % solidification agent, between about 25 wt % and about 38 wt % chelating agent and between about 25 wt % and about 30 wt % alkalinity source. In other embodiments, similar intermediate concentrate may also be present in the detergent compositions of the invention.

The solid detergent compositions of the present invention are substantially free of phosphorus-containing compounds and alkyl phenol ethoxylates (APEs), making the solid detergent composition more environmentally preferred. Phosphorus-free refers to a composition, mixture, or ingredients to which phosphorus-containing compounds are not added. Should phosphorus-containing compounds be present through contamination of a phosphorus-free composition, mixture, or ingredient, the level of phosphorus-containing compounds in the resulting composition is less than approximately 0.5 wt %, less than approximately 0.1 wt %, and often less than approximately 0.01 wt %. APE-free refers to a composition, mixture, or ingredients to which APEs are not added. Should APEs be present through contamination of an APE-free composition, mixture, or ingredient, the level of APEs in the resulting composition is less than approximately 0.5 wt %, less than approximately 0.1 wt %, and often less than approximately 0.01 wt %.

Additional Functional Materials

The solid detergent composition can include additional components or agents, such as additional functional materials. As such, in some embodiments, the detergent composition including the ethoxylated and propoxylated surfactant or surfactant blend, solidification agent, chelating agent and alkalinity source may provide a large amount, or even all of the total weight of the detergent composition, for example, in embodiments having few or no additional functional materials disposed therein. The functional materials provide desired properties and functionalities to the detergent composition. For the purpose of this application, the term "functional materials" include a material that when dispersed or dissolved in a use and/or concentrate solution, such as an aqueous solution, provides a beneficial property in a particular use. The solid detergent composition containing the ethoxylated and propoxylated surfactant or surfactant blend, solidification agent, chelating agent and alkalinity source may optionally contain other soil-digesting components, surfactants, disinfectants, sanitizers, acidulants, complexing agents, corrosion inhibitors, foam inhibitors, dyes, thickening or gelling agents, and perfumes, as described, for example, in U.S. Pat. No. 7,341,983, incorporated herein by reference. Some particular examples of functional materials are discussed in more detail below, but it should be understood by those of skill in the art and others that the particular materials discussed are given by way of example only, and that a broad variety of other functional materials may be used. For example, many of the functional materials discussed below relate to materials used in cleaning and/or destaining applications, but it should be understood that other embodiments may include functional materials for use in other applications.

Surfactants

The solid detergent composition can contain additional surfactants. For example, the solid detergent composition may contain anionic, cationic, amphoteric, nonionic and/or zwitteronic surfactants. Anionic surfactants are desirable in cleaning compositions because of their wetting and detersive properties. The anionic surfactants that can be used according to the invention include any anionic surfactant available in the cleaning industry. Suitable groups of anionic surfactants include sulfonates and sulfates. Suitable surfactants that can be provided in the anionic surfactant component include alkyl aryl sulfonates, secondary alkane sulfonates, alkyl methyl ester sulfonates, alpha olefin sulfonates, alkyl ether sulfates, alkyl sulfates, and alcohol sulfates.

Suitable alkyl aryl sulfonates that can be used in the solid detergent composition can have an alkyl group that contains 6 to 24 carbon atoms and the aryl group can be at least one of benzene, toluene, and xylene. An suitable alkyl aryl sulfonate includes linear alkyl benzene sulfonate. An suitable linear alkyl benzene sulfonate includes linear dodecyl benzyl sulfonate that can be provided as an acid that is neutralized to form the sulfonate. Additional suitable alkyl aryl sulfonates include xylene sulfonate and cumene sulfonate.

Suitable alkane sulfonates that can be used in the solid detergent composition can have an alkane group having 6 to 24 carbon atoms. Suitable alkane sulfonates that can be used include secondary alkane sulfonates. An suitable secondary alkane sulfonate includes sodium $C_{14}$-$C_{17}$ secondary alkyl sulfonate commercially available as Hostapur SAS from Clariant.

Suitable alkyl methyl ester sulfonates that can be used in the solid detergent composition include those having an alkyl group containing 6 to 24 carbon atoms. Suitable alpha olefin sulfonates that can be used in the cleaning composition include those having alpha olefin groups containing 6 to 24 carbon atoms.

Suitable alkyl ether sulfates that can be used in the solid detergent composition include those having between about 1 and about 10 repeating alkoxy groups, between about 1 and about 5 repeating alkoxy groups. In general, the alkoxy group will contain between about 2 and about 4 carbon atoms. An suitable alkoxy group is ethoxy. An suitable alkyl ether sulfate is sodium lauric ether ethoxylate sulfate and is available under the name Steol CS-460.

Suitable alkyl sulfates that can be used in the solid detergent composition include those having an alkyl group containing 6 to 24 carbon atoms. Suitable alkyl sulfates include, but are not limited to, sodium laurel sulfate and sodium laurel/myristyl sulfate.

Suitable alcohol sulfates that can be used in the solid detergent composition include those having an alcohol group containing about 6 to about 24 carbon atoms.

The anionic surfactant can be neutralized with an alkaline metal salt, an amine, or a mixture thereof. Suitable alkaline metal salts include sodium, potassium, and magnesium. Suitable amines include monoethanolamine, triethanolamine, and monoisopropanolamine. If a mixture of salts is used, a suitable mixture of alkaline metal salt can be sodium and magnesium, and the molar ratio of sodium to magnesium can be between about 3:1 and about 1:1.

The solid detergent composition, when provided as a concentrate, can include the anionic surfactant component in an amount sufficient to provide a use composition having desired wetting and detersive properties after dilution with water. The concentrate can contain about 0.1 wt % to about 0.5 wt %, about 0.1 wt % to about 1.0 wt %, about 1.0 wt % to about 5 wt %, about 5 wt % to about 10 wt %, about 10 wt % to about 20 wt %, 30 wt %, about 0.5 wt % to about 25 wt %, and about 1 wt % to about 15 wt %, and similar intermediate concentrations of the anionic surfactant.

The solid detergent composition can contain a nonionic surfactant component that includes a detersive amount of nonionic surfactant or a mixture of nonionic surfactants. Nonionic surfactants can be included in the cleaning composition to enhance grease removal properties. Although the surfactant component can include a nonionic surfactant component, it should be understood that the nonionic surfactant component can be excluded from the detergent composition.

Nonionic surfactants that can be used in the composition include polyalkylene oxide surfactants (also known as polyoxyalkylene surfactants or polyalkylene glycol surfactants). Suitable polyalkylene oxide surfactants include polyoxypropylene surfactants and polyoxyethylene glycol surfactants. Suitable surfactants of this type are synthetic organic polyoxypropylene (PO)-polyoxyethylene (EO) block copolymers. These surfactants include a di-block polymer comprising an EO block and a PO block, a center block of polyoxypropylene units (PO), and having blocks of polyoxyethylene grafted onto the polyoxypropylene unit or a center block of EO with attached PO blocks. Further, this surfactant can have further blocks of either polyoxyethylene or polyoxypropylene in the molecules. A suitable average molecular weight range of useful surfactants can be about 1,000 to about 40,000 and the weight percent content of ethylene oxide can be about 10-80 wt %.

Additional nonionic surfactants include alcohol alkoxylates. An suitable alcohol alkoxylate include linear alcohol ethoxylates such as Tomadol™ 1-5 which is a surfactant containing an alkyl group having 11 carbon atoms and 5 moles of ethylene oxide. Additional alcohol alkoxylates include branched alcohol ethoxylates, secondary alcohol ethoxylates (e.g., Tergitol 15-S-7 from Dow Chemical), castor oil ethoxylates, alkylamine ethoxylates, tallow amine ethoxylates, fatty acid ethoxylates, sorbital oleate ethoxylates, end-capped ethoxylates, or mixtures thereof. Additional nonionic surfactants include amides such as fatty alkanolamides, alkyldiethanolamides, coconut diethanolamide, lauramide diethanolamide, cocoamide diethanolamide, polyethylene glycol cocoamide (e.g., PEG-6 cocoamide), oleic diethanolamide, or mixtures thereof. Additional suitable nonionic surfactants include polyalkoxylated aliphatic base, polyalkoxylated amide, glycol esters, glycerol esters, amine oxides, fatty triglycerides, fatty triglyceride esters, alkyl ether phosphate, alkyl esters, esters, alkyl polysaccharides, block copolymers, alkyl polyglucosides, or mixtures thereof.

When nonionic surfactants are included in the solid detergent composition concentrate, they can be included in an amount of at least about 0.1 wt % and can be included in an amount of up to about 15 wt %. The concentrate can include about 0.1 to 1.0 wt %, about 0.5 wt % to about 12 wt % or about 2 wt % to about 10 wt % of the nonionic surfactant.

Amphoteric surfactants can also be used to provide desired detersive properties. Suitable amphoteric surfactants that can be used include, but are not limited to: betaines, imidazolines, and propionates. Suitable amphoteric surfactants include, but are not limited to: sultaines, amphopropionates, amphrodipropionates, aminopropionates, aminodipropionates, amphoacetates, amphodiacetates, and amphohydroxypropylsulfonates.

When the solid detergent composition includes an amphoteric surfactant, the amphoteric surfactant can be included in an amount of about 0.1 wt % to about 15 wt %. The concentrate can include about 0.1 wt % to about 1.0 wt %, 0.5 wt % to about 12 wt % or about 2 wt % to about 10 wt % of the amphoteric surfactant.

The solid detergent composition can contain a cationic surfactant component that includes a detersive amount of cationic surfactant or a mixture of cationic surfactants. The cationic surfactant can be used to provide sanitizing properties.

Cationic surfactants that can be used in the solid detergent composition include, but are not limited to: amines such as primary, secondary and tertiary monoamines with $C_{1-8}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl($C_{12}$-$C_{18}$)dimethylbenzyl ammonium chloride, n-tetradecyldimethylbenzylammonium chloride monohydrate, and a naphthylene-substituted quaternary ammonium chloride such as dimethyl-1-naphthylmethylammonium chloride.

The solid detergent composition can contain a zwitterionic surfactant component that includes a detersive amount of zwitterionic surfactant or a mixture of zwitterionic surfactants.

Examples of zwitterionic surfactants that can be used in the solid detergent composition include, but are not limited to: betaines, imidazolines, and propionates.

Water

It should be understood that water provided as part of the concentrate can be relatively free of hardness. It is expected that the water can be deionized to remove a portion of the dissolved solids. The concentrate is then diluted with water available at the locale or site of dilution and that water may contain varying levels of hardness depending upon the locale. Although deionized can be used for formulating the concentrate, the concentrate also can be formulated with water that has not been deionized. That is, the concentrate can be formulated with water that includes dissolved solids, and can be formulated with water that can be characterized as hard water.

Anti-Redeposition Agent

The solid detergent composition can include an anti-redeposition agent for facilitating sustained suspension of soils in a detergent solution and preventing the removed soils from being redeposited onto the substrate being cleaned. Examples of suitable anti-redeposition agents include, but are not limited to: polyacrylates, styrene maleic anhydride copolymers, cellulosic derivatives such as hydroxyethyl cellulose, and hydroxypropyl cellulose. An example of a particularly suitable anti-redeposition agent includes, but is not limited to, sodium carboxymethyl cellulose.

In concentrate form, the solid detergent compositions include an anti-redeposition agent at concentrations of up to about 5 wt % and particularly between about 1 wt % and about 3 wt %.

Optical Brightener

The solid detergent composition can optionally include an optical brightener, also referred to as a fluorescent whitening agent or a fluorescent brightening agent, and can provide optical compensation for the yellow cast in fabric substrates.

Fluorescent compounds belonging to the optical brightener family are typically aromatic or aromatic heterocyclic materials often containing a condensed ring system. A feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (naphthalamides, triazines, etc.). The choice of optical brighteners for use in compositions will depend upon a number of factors, such as the type of composition, the nature of other components present in the composition, the temperature of the wash water, the degree of agitation, and the ratio of the material washed to the tub size. The brightener selection is also dependent upon the type of material to be cleaned, e.g., cottons, synthetics, etc. Because most laundry detergent products are used to clean a variety of fabrics, the detergent compositions may contain a mixture of brighteners which are effective for a variety of fabrics. It is of course necessary that the individual components of such a brightener mixture be compatible.

Examples of suitable optical brighteners are commercially available and will be appreciated by those skilled in the art. At least some commercial optical brighteners can be classified into subgroups, including, but are not limited to: derivatives of stilbene, pyrazoline, carboxylic acid, methinecyanines, dibenzothiophene-5,5-dioxide, azoles, 5- and 6-membered-ring heterocycles, and other miscellaneous agents. Examples of particularly suitable optical brightening agents include, but are not limited to: distyryl biphenyl disulfonic acid sodium salt, and cyanuric chloride/diaminostilbene disulfonic acid sodium salt. Examples of suitable commercially available optical brightening agents include, but are not limited to: Tinopal 5 BM-GX, Tinopal CBS-CL, Tinopal CBS-X, and Tinopal AMS-GX, available from Ciba Specialty Chemicals Corporation, Greensboro, N.C. Examples of optical brighteners are also disclosed in "The Production and Application of Fluorescent Brightening Agents", M. Zahradnik, Published by John Wiley & Sons, New York (1982), the disclosure of which is incorporated herein by reference.

Suitable stilbene derivatives include, but are not limited to: derivatives of bis(triazinyl)amino-stilbene, bisacylamino derivatives of stilbene, triazole derivatives of stilbene, oxadiazole derivatives of stilbene, oxazole derivatives of stilbene, and styryl derivatives of stilbene. An example of a particularly suitable optical brightener includes, but is not limited to, stilbene disulfonic acid. In concentrate form, the solid detergent compositions include a solidifoptical brightener at concentrations of up to about 2 wt % and particularly between about 0.1 wt % and about 0.3 wt %.

Thickener/Viscosity Modifying Agent

The solid detergent composition of the present invention also includes a thickener or a viscosity modifying agent. The viscosity of the composition increases with the amount of thickening agent, and viscous compositions are useful for uses where the detergent composition clings to the surface. Suitable thickeners can include those which do not leave contaminating residue on the surface to be treated. Generally, thickeners which may be used in the present invention include natural gums such as xanthan gum, guar gum, modified guar, or other gums from plant mucilage; polysaccharide based thickeners, such as alginates, starches, and cellulosic polymers (e.g., carboxymethyl cellulose, hydroxyethyl cellulose, and the like); polyacrylates thickeners; and hydrocolloid thickeners, such as pectin. An example of a particularly suitable thickener includes sodium polyacrylate.

In concentrate form, the solid detergent compositions include a thickener at concentrations of up to about 10 wt % and particularly between about 2 and about 4 wt %. In other embodiments, similar intermediate concentrates may also be present in the detergent compositions of the invention.

Enzymes

Enzymes that can be included in the solid detergent composition include those enzymes that aid in the removal of starch and/or protein stains. Exemplary types of enzymes include, but are not limited to: proteases, alpha-amylases, and mixtures thereof. Exemplary proteases that can be used include, but are not limited to: those derived from *Bacillus licheniformix, Bacillus lenus, Bacillus alcalophilus*, and *Bacillus amyloliquefacins*. Exemplary alpha-amylases include *Bacillus subtilis, Bacillus amyloliquefaceins* and *Bacillus licheniformis*. The concentrate need not include an enzyme, but when the concentrate includes an enzyme, it can be included in an amount that provides the desired enzymatic activity when the solid detergent composition is provided as a use composition.

Exemplary ranges of the enzyme in the concentrate include up to approximately 15% by weight, between approximately 0.1 wt % to approximately 10 wt % and particularly between approximately 0.1 wt % to approximately 5 wt %.

Bleaching Agents

Bleaching agents suitable for use in the solid detergent composition for lightening or whitening a substrate include bleaching compounds capable of liberating an active halogen species, such as $Cl_2$, $Br_2$, —OCl— and/or —OBr—, under conditions typically encountered during the cleansing process. Suitable bleaching agents for use in the solid detergent compositions include, but are not limited to: chlorine-containing compounds such as chlorines, hypochlorites, or chloramines. Exemplary halogen-releasing compounds include, but are not limited to: the alkali metal dichloroisocyanurates, chlorinated trisodium phosphate, the alkali metal hypochlorites, monochloramine, and dichloramine. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be a peroxygen or active oxygen source such as hydrogen peroxide, perborates, sodium carbonate peroxyhydrate, potassium permonosulfate, and sodium perborate mono and tetrahydrate, with and without activators such as tetraacetylethylene diamine or catalytic bleach activators.

When the concentrate includes a bleaching agent, it can be included in an amount of between approximately 0.001 wt % and approximately 60 wt %, between approximately 1 wt % and approximately 20 wt %, between approximately 3 wt % and approximately 8 wt %, and between approximately 3 wt % and approximately 6 wt %.

Rinse Aids

The detergent composition can optionally include a rinse aid composition, for example a rinse aid formulation containing a wetting or sheeting agent combined with other optional ingredients in a solid composition made using the binding agent. The rinse aid components are capable of reducing the surface tension of the rinse water to promote sheeting action and/or to prevent spotting or streaking caused by beaded water after rinsing is complete, for example in warewashing processes. Examples of sheeting agents include, but are not limited to: polyether compounds prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule.

Sanitizers/Anti-Microbial Agents

The solid detergent composition can optionally include a sanitizing agent (or antimicrobial agent). Sanitizing agents, also known as antimicrobial agents, are chemical compositions that can be used to prevent microbial contamination and deterioration of material systems, surfaces, etc. Generally, these materials fall in specific classes including phenolics, halogen compounds, quaternary ammonium compounds, metal derivatives, amines, alkanol amines, nitro derivatives, anilides, organosulfur and sulfur-nitrogen compounds and miscellaneous compounds.

The given antimicrobial agent, depending on chemical composition and concentration, may simply limit further proliferation of numbers of the microbe or may destroy all or a portion of the microbial population. The terms "microbes" and "microorganisms" typically refer primarily to bacteria, virus, yeast, spores, and fungus microorganisms. In use, the antimicrobial agents are typically formed into a solid functional material that when diluted and dispensed, optionally, for example, using an aqueous stream forms an aqueous disinfectant or sanitizer composition that can be contacted with a variety of surfaces resulting in prevention of growth or the killing of a portion of the microbial population. A three log reduction of the microbial population results in a sanitizer composition. The antimicrobial agent can be encapsulated, for example, to improve its stability.

Examples of suitable antimicrobial agents include, but are not limited to, phenolic antimicrobials such as pentachlorophenol; orthophenylphenol; chloro-p-benzylphenols; p-chloro-m-xylenol; quaternary ammonium compounds such as alkyl dimethylbenzyl ammonium chloride; alkyl dimethylethylbenzyl ammonium chloride; octyl decyldimethyl ammonium chloride; dioctyl dimethyl ammonium chloride; and didecyl dimethyl ammonium chloride. Examples of suitable halogen containing antibacterial agents include, but are not limited to: sodium trichloroisocyanurate, sodium dichloro isocyanate (anhydrous or dihydrate), iodine-poly (vinylpyrrolidinone) complexes, bromine compounds such as 2-bromo-2-nitropropane-1,3-diol, and quaternary antimicrobial agents such as benzalkonium chloride, didecyldimethyl ammonium chloride, choline diiodochloride, and tetramethyl phosphonium tribromide. Other antimicrobial compositions such as hexahydro-1,3,5-tris(2-hydroxyethyl)-s-triazine, dithiocarbamates such as sodium dimethyldithiocarbamate, and a variety of other materials are known in the art for their antimicrobial properties.

It should also be understood that active oxygen compounds, such as those discussed above in the bleaching agents section, may also act as antimicrobial agents, and can even provide sanitizing activity. In fact, in some embodiments, the ability of the active oxygen compound to act as an antimicrobial agent reduces the need for additional antimicrobial agents within the composition. For example, percarbonate compositions have been demonstrated to provide excellent antimicrobial action.

Activators

In some embodiments, the antimicrobial activity or bleaching activity of the solid detergent composition can be enhanced by the addition of a material which, when the solid detergent composition is placed in use, reacts with the active oxygen to form an activated component. For example, in some embodiments, a peracid or a peracid salt is formed. For example, in some embodiments, tetraacetylethylene diamine can be included within the solid detergent composition to react with the active oxygen and form a peracid or a peracid salt that acts as an antimicrobial agent. Other examples of active oxygen activators include transition metals and their compounds, compounds that contain a carboxylic, nitrile, or ester moiety, or other such compounds known in the art. In an embodiment, the activator includes tetraacetylethylene diamine; transition metal; compound that includes carboxylic, nitrile, amine, or ester moiety; or mixtures thereof. In some embodiments, an activator for an active oxygen compound combines with the active oxygen to form an antimicrobial agent.

In some embodiments, an activator material for the active oxygen is coupled to the solid block. The activator can be coupled to the solid block by any of a variety of methods for coupling one solid detergent composition to another. For example, the activator can be in the form of a solid that is bound, affixed, glued or otherwise adhered to the solid block. Alternatively, the solid activator can be formed around and encasing the block. By way of further example, the solid activator can be coupled to the solid block by the container or package for the detergent composition, such as by a plastic or shrink wrap or film.

Detergent Builders or Fillers

The solid detergent composition can optionally include a minor but effective amount of one or more of a detergent filler which does not necessarily perform as a cleaning agent per se, but may cooperate with a cleaning agent to enhance the overall cleaning capacity of the composition. Examples of suitable fillers include, but are not limited to: sodium sulfate, sodium chloride, starch, sugars, and $C_1$-$C_{10}$ alkylene glycols such as propylene glycol.

pH Buffering Agents

Additionally, the solid detergent composition can be formulated such that during use in aqueous operations, for example in aqueous detergent operations, the wash water will have a desired pH. For example, a souring agent may be added to the detergent composition such that the pH of the textile approximately matches the proper processing pH. The souring agent is a mild acid used to neutralize residual alkalines and reduce the pH of the textile such that when the garments come into contact with human skin, the textile does not irritate the skin Examples of suitable souring agents include, but are not limited to: phosphoric acid, formic acid, acetic acid, hydrofluorosilicic acid, saturated fatty acids, dicarboxylic acids, tricarboxylic acids, and any combination thereof. Examples of saturated fatty acids include, but are not limited to: those having 10 or more carbon atoms such as palmitic acid, stearic acid, and arachidic acid (C20). Examples of dicarboxylic acids include, but are not limited to: oxalic acid, tartaric acid, glutaric acid, succinic acid, adipic acid, and sulfamic acid. Examples of tricarboxylic acids include, but are not limited to: citric acid and tricarballylic acids. Examples of suitable commercially available souring agents include, but are not limited to: TurboLizer, Injection Sour, TurboPlex, AdvaCare 120 Sour, AdvaCare 120 Sanitizing Sour, CarboBrite, and Econo Sour, all available from Ecolab Inc., St. Paul, Minn.

Fabric Relaxants

A fabric relaxant may be added to the solid detergent composition to increase the smoothness appearance of the surface of the textile.

Fabric Softeners

A fabric softener may also be added to the solid detergent composition to soften the feel of the surface of the textile. An example of a suitable commercially available fabric softener includes, but is not limited to, TurboFresh, available from Ecolab Inc., St. Paul, Minn.

Soil Releasing Agents

The solid detergent composition can include soil releasing agents that can be provided for coating the fibers of textiles to reduce the tendency of soils to attach to the fibers. Examples of suitable commercially available soil releasing agents include, but are not limited to: polymers such as Repel-O-Tex SRP6 and Repel-O-Tex PF594, available from Rhodia, Cranbury, N.J.; TexaCare 100 and TexaCare 240, available from Clariant Corporation, Charlotte, N.C.; and Sokalan HP22, available from BASF Corporation, Florham Park, N.J.

Defoaming Agents

The solid detergent composition can optionally include a minor but effective amount of a defoaming agent for reducing the stability of foam. Examples of suitable defoaming agents include, but are not limited to: silicone compounds such as silica dispersed in polydimethylsiloxane, fatty amides, hydrocarbon waxes, fatty acids, fatty esters, fatty alcohols, fatty acid soaps, ethoxylates, mineral oils, polyethylene glycol esters, and alkyl phosphate esters such as monostearyl phosphate. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-Static Agents

The solid detergent composition can include an anti-static agent such as those commonly used in the laundry drying industry to provide anti-static properties. Anti-static agents can generate a percent static reduction of at least about 50% when compared with a textile that is not subjected to treatment. The percent static reduction can be greater than 70% and it can be greater than 80%. An example of an anti-static agent includes, but is not limited to, an agent containing quaternary groups.

Anti-Wrinkling Agents

The solid detergent composition can include anti-wrinkling agents to provide anti-wrinkling properties. Examples of anti-wrinkling suitable agents include, but are not limited to: siloxane or silicone containing compounds and quaternary ammonium compounds. Particularly suitable examples of anti-wrinkling agents include, but are not limited to: polydimethylsiloxane diquaternary ammonium, silicone copolyol fatty quaternary ammonium, and polydimethyl siloxane with polyoxyalkylenes. Examples of commercially available anti-wrinkling agents include, but are not limited to: Rewoquat SQ24, available from Degussa/Goldschmidt Chemical Corporation, Hopewell, Va.; Lube SCI-Q, available from Lambert Technologies; and Tinotex CMA, available from Ciba Specialty Chemicals Corporation, Greensboro, N.C.

Odor-Capturing Agents

The solid detergent composition can include odor capturing agents. In general, odor capturing agents are believed to function by capturing or enclosing certain molecules that provide an odor. Examples of suitable odor capturing agents include, but are not limited to: cyclodextrins and zinc ricinoleate.

Fiber Protection Agents

The solid detergent composition can include fiber protection agents that coat the fibers of the textile to reduce or prevent disintegration and/or degradation of the fibers. An example of a fiber protection agent includes, but is not limited to, cellulosic polymers.

Color Protection Agents

The solid detergent composition can include color protection agents for coating the fibers of a textile to reduce the tendency of dyes to escape the textile into water. Examples of suitable color protection agents include, but are not limited to: quaternary ammonium compounds and surfactants. Examples of particularly suitable color protection agents include, but are not limited to: di-(nortallow carboxyethyl) hydroxyethyl methyl ammonium methylsulfate and cationic polymers. Examples of commercially available surfactant color protection agents include, but are not limited to: Varisoft WE 21 CP and Varisoft CCS-1, available from Degussa/Goldschmidt Chemical Corporation, Hopewell, Va.; Tinofix CL from Ciba Specialty Chemicals Corporation, Greensboro, N.C.; Color Care Additive DFC 9, Thiotan TR, Nylofixan P-Liquid, Polymer VRN, Cartaretin F-4, and Cartaretin F-23, available from Clariant Corporation, Charlotte, N.C.; EXP 3973 Polymer, available from Alcoa Inc., Pittsburgh, Pa.; and Coltide, available from Croda International Plc, Edison N.J.

UV Protection Agents

The solid detergent composition can include a UV protection agent to provide the fabric with enhanced UV protection. In the case of clothing, it is believed that by applying UV protection agents to the clothing, it is possible to reduce the harmful effects of ultraviolet radiation on skin provided underneath the clothing. As clothing becomes lighter in weight, UV light has a greater tendency to penetrate the clothing and the skin underneath the clothing may become sunburned. An example of a suitable commercially available UV protection agent includes, but is not limited to, Tinosorb FD, available from Ciba Specialty Chemicals Corporation, Greensboro, N.C.

Anti-Pilling Agents

The solid detergent composition can include an anti-pilling agent that acts on portions of fibers that stick out or away from the fiber. Anti-pilling agents can be available as enzymes such as cellulase enzymes. Examples of commercially available anti-pilling agents include, but are not limited to: Puradex, available from Genencor International, Pal Alto, Calif.; and Endolase and Carezyme, available from Novozyme, Franklinton, N.C.

Water Repellency Agents

The solid detergent composition can include water repellency agents that can be applied to textile to enhance water repellent properties. Examples of suitable water repellenancy agents include, but are not limited to: perfluoroacrylate copolymers, hydrocarbon waxes, and polysiloxanes.

Hardening Agents/Solubility Modifiers

The solid detergent composition may include a minor but effective amount of a hardening agent. Examples of suitable hardening agents include, but are not limited to: an amide such stearic monoethanolamide or lauric diethanolamide, an alkylamide, a solid polyethylene glycol, a solid EO/PO block copolymer, starches that have been made water-soluble through an acid or alkaline treatment process, and various inorganics that impart solidifying properties to a heated composition upon cooling. Such compounds may also vary the solubility of the composition in an aqueous medium during use such that the detergent agent and/or other active ingredients may be dispensed from the solid composition over an extended period of time.

Insect Repellants

The solid detergent composition can include insect repellents such as mosquito repellents. An example of a commercially available insect repellent is DEET. In addition, the aqueous carrier solution can include mildewcides that kill mildew and allergicides that reduce the allergic potential present on certain textiles and/or provide germ proofing properties.

Dyes and Fragrances

Various dyes, odorants including perfumes, and other aesthetic enhancing agents may also be included in the cleaning composition. Dyes may be included to alter the appearance of the composition, as for example, any of a variety of FD&C dyes, D&C dyes, and the like. Additional suitable dyes include Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Anailine and Chemical), Metanil Yellow (Keystone Anailine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (BASF), Pylakor Acid Bright Red (Pylam), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Embodiments of the Present Compositions

Suitable exemplary concentrate compositions are provided in the following table.

TABLE 1

| Exemplary Composition | | | |
|---|---|---|---|
| Component | First Range (Wt %) | Second Range (Wt %) | Third Range (Wt %) |
| Ethoxylated and Propoxylated Surfactant or Surfactant Blend | 1-60 | 10-40 | 15-30 |
| Solidification Agent | 1-12 | 2-10 | 4-8 |
| Chelating Agent | 1-60 | 10-40 | 25-38 |
| Anti-Redeposition Agent | 0-5 | 0.5-4 | 1-3 |
| Optical Brightener | 0-2 | 0.1-1 | 0.1-0.3 |
| Thickener/Viscosity Modifier | 0-10 | 1-8 | 2-4 |
| Alkalinity Source | 1-50 | 10-40 | 25-30 |

The concentrate composition of the invention is provided as a solid. The solid detergent composition may be made using a mixing process. The detergent composition including the surfactant or surfactant blend, solidification agent, water conditioning agent, alkalinity source and other functional ingredients are mixed for an amount of time sufficient to form a final, homogeneous composition. In an exemplary embodiment, the components of the solid detergent composition are mixed for approximately 10 minutes. The solid detergent composition may be provided in concentrated form and may need to be diluted to form a use solution subsequent to application.

In one embodiment, the detergent compositions may be provided as a concentrate such that the solid detergent composition is substantially free of any added water or the concentrate may contain a nominal amount of water. The concentrate can be formulated without any water or can be provided with a relatively small amount of water in order to reduce the expense of transporting the concentrate. For example, the composition concentrate can be provided as a pellet, tablet, compressed powder, loose powder or a capsule or pellet of compressed powder, a solid, or loose powder, either contained by a water soluble material or not. In the case of providing the capsule or pellet of the composition in a material, the capsule or pellet can be introduced into a volume of water, and if present the water soluble material can solubilize, degrade, or disperse to allow contact of the composition concentrate with the water. For the purposes of this disclosure, the terms "capsule" and "pellet" are used for exemplary purposes and are not intended to limit the delivery mode of the invention to a particular shape.

In one embodiment, the concentrate composition can be provided in a solid form that resists crumbling or other degradation until placed into a container. Such container may either be filled with water before placing the composition concentrate into the container, or it may be filled with water after the composition concentrate is placed into the container. In either case, the solid concentrate composition dissolves, solubilizes, or otherwise disintegrates upon contact with water. In a preferred embodiment, the solid concentrate composition dissolves rapidly thereby allowing the concentrate composition to become a use composition and further allowing the end user to apply the use composition to a surface in need of cleaning.

In another embodiment, the solid concentrate composition can be diluted through dispensing equipment whereby water is sprayed at the solid block forming the use solution. The water flow is delivered at a relatively constant rate using mechanical, electrical, or hydraulic controls and the like. The solid concentrate composition can also be diluted through dispensing equipment whereby water flows around the solid block, creating a use solution as the solid concentrate dissolves. The solid concentrate composition can also be diluted through pellet, tablet, powder and paste dispensers, and the like.

The water of dilution that is used to dilute the concentrate can be characterized as hard water when it includes at least 1 grain hardness. It is expected that the water of dilution can include at least 5 grains hardness, at least 10 grains hardness, or at least 20 grains hardness.

It is expected that the concentrate will be diluted with the water of dilution in order to provide a use solution having a desired level of detersive properties. If the use solution is required to remove tough or heavy soils, it is expected that the concentrate can be diluted with the water of dilution at a weight ratio of at least 1:1 and up to 1:8. If a light duty detergent use solution is desired, it is expected that the concentrate can be diluted at a weight ratio of concentrate to water of dilution of up to about 1:256.

Compositions of the invention may be useful to clean soiled linens such as towels, sheets, and nonwoven webs. As such, compositions of the invention are useful to formulate laundry detergents. For example, the detergent composition may be used to prevent crystallization of calcium onto the surface of textiles and to remove soil from the surface of textiles. After the detergent composition including the surfactant or surfactant blend, solidification agent, water conditioning agent, alkalinity source and other functional ingredients are diluted in water to form a use solution, the use solution is then applied onto the surface for an amount of time sufficient to remove soils from the surface. In an exemplary embodiment, the use solution remains on the surface of at least approximately 4 minutes to effectively remove the soils from the surface. The use solution is then rinsed from the surface.

EXAMPLES

The present invention is more particularly described in the following examples that are intended as illustrations only, since numerous modifications and variations within the scope of the present invention will be apparent to those skilled in the art. Unless otherwise noted, all parts, percentages, and ratios reported in the following examples are on a weight basis, and all reagents used in the examples were obtained, or are available, from the chemical suppliers described below, or may be synthesized by conventional techniques.

Materials Used

Ecosurf SA-7: a surfactant having $C_8$-$C_{18}$ carbon chains containing both moles of ethoxylation and propoxylation, available from Dow Chemical Company, Midland, Mich.

Ecosurf SA-3: a surfactant having $C_8$-$C_{18}$ carbon chains containing both moles of ethoxylation and propoxylation, available from Dow Chemical Company, Midland, Mich.

Palm Kernal Ethoxylate 3 and Palm Kernal Ethoxylate 7: a naturally-derived surfactant blend having $C_{12}$-$C_{14}$ carbon chains (some $C_{10}$ and $C_{16}$ carbon chains) containing moles of ethoxylation, from Dow Chemical Company, Midland, Mich.

Linear Alcohol Ethoxylate (LAE) 25-7: a surfactant having $C_{12}$-$C_{15}$ carbon chains containing moles of ethoxylation available from Tomadol Products, Inc., Milton, Wis.

Linear Alcohol Ethoxylate (LAE) 25-3: a surfactant having $C_{12}$-$C_{15}$ carbon chains containing moles of ethoxylation available from Tomadol Products, Inc., Milton, Wis.

Example 1 and Comparative Examples A and B

To determine the average dispense rate of each of the compositions, a dispense curve was generated using a Solid System 1 Dispenser hooked up to a load cell. A program controlled the dispenser. The weight of the product and dispenser were first taken and recorded in a database. Each of the sample compositions were sprayed with warm water (about 105 degrees Fahrenheit) at about 20 pounds per square inch (psi) for about 1 minute. The program accounted for the time it took the remaining water to flow out of the dispenser and then recorded the weight of the product and dispenser. After a 15 minute lapse, the cycle was repeated. The difference between the weight before and after each spray was the total amount of product dispensed. The average dispense rate of each of the compositions was measured in grams per minute.

Three compositions having different surfactant blends were formulated. All of the compositions included the same weight percent of surfactant, PEG 4000, sodium aluminosilicate, dye, sodium carboxylmethyl cellulose, stilbene disulfonic acid, sodium polyacrylate, fragrance, sodium carbonate and defoamer, as listed below in Table 1. The only difference among the compositions was the surfactant blend used.

The composition of Example 1 included a blend of Ecosurf SA-7 and Ecosurf SA-3.

The composition of Comparative Example A included a blend of Palm Kernal Ethoxylate 7 (PKE-7) and Palm Kernal Ethoxylate 3 (PKE-3). The composition of Comparative Example B included a blend of Linear Alcohol Ethoxylate 25-7 and Linear Alcohol Ethoxylate 25-3. Both surfactant blends of Comparative Examples A and B contained only moles of ethoxylation.

The compositions of Comparative Examples C, D and E are commercially known an available detergents. In particular, the composition of Comparative Example C is Solid Super Star, the composition of Comparative Example D is Solid Super Star NP (no phosphorus) and the composition of Comparative Example E is Super Star NP NA (no phosphorus or nonyl phenol ethoxylate).

Table 1 shows the component compositions for the compositions of Example 1 and Comparative Examples A and B.

TABLE 1

| | Ecosurf SA-7 (wt %) | Ecosurf SA-3 (wt %) | PKE-7 (wt %) | PKE-3 (wt %) | Linear Alcohol Ethoxylate 25-7 (wt %) | Linear Alcohol Ethoxylate 25-3 (wt %) |
|---|---|---|---|---|---|---|
| Example 1 | 20 | 7 | 0 | 0 | 0 | 0 |
| Comparative Example A | 0 | 0 | 20 | 7 | 0 | 0 |
| Comparative Example B | 0 | 0 | 0 | 0 | 20 | 7 |

The average dispense rate of each of the compositions of Example 1 and Comparatives Example A, B, C, D and E were tested and listed in Table 2.

TABLE 2

| | Average Dispense Rate (g/min) |
|---|---|
| Example 1 | 63 |
| Comparative Example A | 38 |
| Comparative Example B | 43 |
| Comparative Example C | 44 |
| Comparative Example D | 48 |
| Comparative Example E | 37 |

As shown in Table 2, even though the ratio of 7 mole to 3 mole ethoxylate surfactant remained the same across the compositions, the dispense rate of the composition of Example 1 was significantly greater than the compositions prepared with the other surfactants (PKE-7, PKE-3, LAE 25-7 and LAE 25-3). In particular, the average dispense rate of the composition of Example 1 was more than about 65% faster than the composition of Comparative Example A and more than about 46% faster than the composition of Comparative Example B.

The only difference between the compositions of Example 1 and Comparative Example A, and between the compositions of Example 1 and Comparative Example B was the surfactant blend. Therefore, the results in Table 1 illustrate that a composition including a surfactant blend containing moles of ethoxylation and propoxylation increased the dispensing rate of a solid detergent a greater amount than a composition containing only moles of ethoxylation.

Compared to commercially available detergents in Comparative Examples C, D and E, the composition of the present invention, Example 1, still had a faster average dispense rate. In particular, the average dispense rate of the composition of Example 1 was more than about 43% faster than the composition of Comparative Example C, more than about 31% faster than the composition of Comparative Example D and more than about 70% faster than the composition of Comparative Example E.

Examples 2, 3, 4, 5, 6, 7, 8, 9 and 10 and Comparative Example F

Once it was determined that compositions including a surfactant blend of Ecosurf SA-7 and Ecosurf SA-3 had higher dispensing rates than blends of surfactants having only moles of ethoxylation, various compositions including only one Ecosurf SA surfactant were tested to determine whether the presence of only of the Ecosurf SA surfactants would increase the dispensing rate of a composition.

To determine the average dispense rate of each of the compositions, a dispense curve was generated using a Solid System 1 Dispenser hooked up to a load cell. A program controlled the dispenser. The weight of the product and dispenser were first taken and recorded in a database. Each of the sample compositions were sprayed with warm water (about 105 degrees Fahrenheit) at about 20 pounds per square inch (psi) for about 1 minute. The program accounted for the time it took the remaining water to flow out of the dispenser and then recorded the weight of the product and dispenser. After a 15 minute lapse, the cycle was repeated. The difference between the weight before and after each spray was the total amount of product dispensed. The average dispense rate of each of the compositions was measured in grams per minute.

Sixteen compositions having different surfactant blends were formulated. All of the compositions included the same weight percent of surfactant, PEG 4000, sodium aluminosilicate, dye, sodium carboxylmethyl cellulose, stilbene disulfonic acid, sodium polyacrylate, fragrance, sodium carbonate and defoamer, as listed below in Table 3. The only difference among the compositions was the surfactant or surfactant blend used.

The composition of Example 2 included only Ecosurf SA-7 and the composition of Example 3 included only Ecosurf SA-3. The compositions of Examples 4 and 5 included a blend of Ecosurf SA-7, Ecosurf SA-3, Linear Alcohol Ethoxylate 25-7 and Linear Alcohol Ethoxylate 25-3. The composition of Example 6 included Ecosurf SA-7 and Ecosurf SA-3. The composition of Example 7 included a blend of Ecosurf SA-7 and Linear Alcohol Ethoxylate 25-3. The composition of Example 8 included a blend of Linear Alcohol Ethoxylate 25-7 and Ecosurf SA-3. The composition of Example 9 included a blend of Ecosurf SA-7, Linear Alcohol Ethoxylate 25-7 and Linear Alcohol Ethoxylate 25-3. The composition of Example 10 included a blend of Ecosurf SA-3, Linear Alcohol Ethoxylate 25-7 and Linear Alcohol Ethoxylate 25-3.

The composition of Comparative Example F included a blend of Linear Alcohol Ethoxylate 25-7, Linear Alcohol Ethoxylate 25-3.

Table 3 shows the component compositions for the compositions of Examples 2-10 and Comparative Example F.

TABLE 3

| | Ecosurf SA-7 (wt %) | Ecosurf SA-3 (wt %) | Linear Alcohol Ethoxylate 25-7 (wt %) | Linear Alcohol Ethoxylate 25-3 (wt %) |
|---|---|---|---|---|
| Example 2 | 27 | 0 | 0 | 0 |
| Example 3 | 0 | 27 | 0 | 0 |
| Example 4 | 3.7 | 1.3 | 16.28 | 5.72 |
| Example 5 | 7.4 | 2.6 | 12.58 | 4.42 |
| Example 6 | 20 | 7 | 0 | 0 |
| Example 7 | 20 | 0 | 0 | 7 |
| Example 8 | 0 | 7 | 20 | 0 |
| Example 9 | 5 | 0 | 15 | 7 |
| Example 10 | 0 | 5 | 20 | 2 |
| Comp. Ex. F | 0 | 0 | 20 | 7 |

The average dispense rate of each of the compositions of Examples 2-10 and Comparative Example F were tested and listed in Table 4.

TABLE 4

| | Average Dispense Rate (g/min) |
|---|---|
| Example 2 | 61 |
| Example 3 | 81 |
| Example 4 | 44 |
| Example 5 | 58 |
| Example 6 | 63 |
| Example 7 | 43 |
| Example 8 | 41 |
| Example 9 | 39 |
| Example 10 | 49 |
| Comparative Example F | 35 |

As can be seen in Table 4, compositions including Ecosurf SA surfactants, either individually or as a blend, exhibit dispensing rates of at least about 40 g/min. In particular, the compositions including at least one Ecosurf SA surfactant had greater dispensing rates than a composition including only linear alcohol ethoxylates (Comparative Example F).

The results in Table 4 also shows that Ecosurf SA-3 had more of an impact on the dispensing rate than Ecosurf SA-7. In particular, the composition of Example 2, which included only Ecosurf SA-7, had a dispensing rate of about 61 g/min, while the composition of Example 3, which included only Ecosurf SA-3, had a dispensing rate of about 81 g/min.

Generally, the results in Table 4 illustrate that the greater the percentage of Ecosurf SA surfactant in the composition, the greater the dispensing rate. In particular, the composition of Example 4, which included about 5% Ecosurf SA surfactant, had a dispensing rate of about 44 g/min, while the composition of Example 5, which included about 10% Ecosurf SA surfactant, had a dispensing rate of about 58 g/min.

Replacing one of the Ecosurf SA surfactant with a linear alcohol ethoxylate surfactants did decrease the dispensing rate. In particular, the composition of Example 6, which included both Ecosurf SA-7 and Ecosurf SA-3, had a dispensing rate of about 63 g/min. By contrast, the compositions of Examples 7 and 8, which replaced one of the Ecosurf SA surfactants with a LAE surfactant, had dispensing rates of about 43 g/min and 41 g/min, respectively.

Various modifications and additions can be made to the exemplary embodiments discussed without departing from the scope of the present invention. For example, while the embodiments described above refer to particular features, the scope of this invention also includes embodiments having different combinations of features and embodiments that do not include all of the above described features.

We claim:

1. A solid detergent composition comprising:

(a) between about 1% and about 60% by weight of an ethoxylated and propoxylated surfactant which comprises a palm kernel based ethoxylate and propoxylate surfactant;

(b) between about 1% and about 50% by weight of an alkalinity source;

(c) between about 1% and about 12% by weight of a solidification agent;

(d) between about 1% and about 60% by weight of a chelating agent; and wherein the solid detergent composition is a cast solid detergent composition and the composition is substantially free of phosphorous-containing compounds and alkyl phenol ethoxylates; and wherein the solid detergent composition exhibits a dispensing rate of at least 40 g/min.

2. The solid detergent composition of claim 1, wherein the ethoxylated and propoxylated surfactant includes between 8 and 18 carbon chains.

3. The solid detergent composition of claim 1, wherein the ethoxylated and propoxylated surfactant has an equilibrium surface tension, as measured at 0.1 wt % and 25° C., of between about 20 dynes/cm and about 40 dynes/cm.

4. A solid detergent composition consisting of:

(a) a palm kernel based surfactant including ethoxylate and propoxylate groups;

(b) an alkalinity source;

(c) a solidification agent;

(d) a chelating agent; and optionally: anti-redeposition agent; optical brightener; thickener/viscosity modifier; dyes and/or fragrances; and wherein the solid detergent composition exhibits a dispensing rate of at least 40 g/min.

5. The solid detergent composition of claim 4, wherein the palm kernel based surfactant constitutes between about 1% and about 60% by weight of the solid detergent composition.

6. The solid detergent composition of claim 4, wherein the palm kernel based surfactant has an equilibrium surface tension, as measured at 0.1 wt % and 25° C., of between about 20 dynes/cm and about 40 dynes/cm.

* * * * *